US006559647B1

(12) United States Patent
Bidner et al.

(10) Patent No.: US 6,559,647 B1
(45) Date of Patent: May 6, 2003

(54) DIAGNOSING SPARK PLUGS MALFUNCTION IN A DUAL PLUG ENGINE

(75) Inventors: David Karl Bidner, Livonia, MI (US); Lynn Edward Davison, Saline, MI (US); William Najib Mansur, Sterling Heights, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 12 days.

(21) Appl. No.: 09/682,953

(22) Filed: Nov. 2, 2001

(51) Int. Cl.[7] ..... F02P 17/00; F02P 15/02

(52) U.S. Cl. ..... 324/393; 324/398; 324/399; 324/391; 123/310

(58) Field of Search ..... 324/393, 398, 324/399, 400; 123/406.64, 310; 701/102, 101

(56) References Cited

U.S. PATENT DOCUMENTS 5,861,551 A * 1/1999 Morita et al. ..... 123/481
5,872,312 A 2/1999 Kalweit
6,211,680 B1 4/2001 Hohner et al.

* cited by examiner

*Primary Examiner*—N. Le
*Assistant Examiner*—James Kerveros
(74) *Attorney, Agent, or Firm*—Diana D. Brehob; Allan J. Lippa

(57) ABSTRACT

The present invention related generally to a method for determining spark plug malfunction and more particularly to a method for determining spark plug malfunction in an internal combustion engine in which at least two spark plugs are disposed in each cylinder. In a dual plug configuration, a spark plug malfunction is detected by disabling one of the spark plugs during a test period in a particular cylinder. A misfire provides an indication of malfunction of the other spark plug.

22 Claims, 2 Drawing Sheets

DIAGNOSING SPARK PLUGS MALFUNCTION IN A DUAL PLUG ENGINE

BACKGROUND OF INVENTION

1. Field of the Invention

The present invention relates generally to a method for determining spark plug malfunction.

2. Background of the Invention

To ensure engine emission performance, it is desirable to perform testing of the engine during operation. An engine equipped with two spark plugs per cylinder provides a unique opportunity to detect a spark plug failure. According to U.S. Pat. No. 5,872,312, one of the two spark plugs in each cylinder in a bank of the engine's cylinders is disabled. Stated another way, one half of the spark plugs in an entire bank are simultaneously disabled. If a misfire is detected during testing on the bank of cylinders, a spark plug of each cylinder is disabled in succession. In this way, it may be determined which spark plug is experiencing a malfunction.

The inventors have recognized a problem with the approach in U.S. Pat. No. 5,872,312 in that, if a spark plug is malfunctioning, two misfires occur in the process of identifying the malfunctioning cylinder, i.e., a first misfire occurs in the bank testing of cylinders and a second misfire in testing individual cylinders. Because a misfire may lead to hydrocarbon emission and may cause overheating of an exhaust catalyst, misfire occurrence should be minimized. The inventors of the present invention have recognized an alternative procedure to detect spark plug malfunction which overcomes the problem of multiple misfires.

SUMMARY OF INVENTION

Disadvantages of prior art approaches are overcome by a method for controlling and diagnosing a multi-cylinder internal combustion engine having two spark plug in each cylinder to determine spark plug malfunction by disabling one of the spark plugs during a test period in a particular cylinder. It is determined whether a misfire has occurred during the disablement, which provides an indication of malfunction of the other spark plug. During the test period, each spark plug is disabled only once.

An advantage of the present invention is that if a spark plug malfunction is occurring, it can be detected in one misfire occurrence. In prior art, two misfires occur in performing the detection scheme. Because misfires lead to short bursts of higher exhaust emissions and a large increase in catalyst temperature, the present invention provides a clear advantage in lower hydrocarbon emission and a lower potential for overheating and possibly melting a catalyst.

An additional advantage is that the present invention requires fewer processes to be undertaken to determine which spark plug is malfunctioning. The algorithm may be performed in a shorter period of time, thereby providing a more rapid identification of a malfunctioning spark plug.

According to another aspect of the present invention, a method for controlling and diagnosing a multi-cylinder internal combustion engine is disclosed in which an ignition spark is provided through a first spark plug positioned in one of the cylinders near a center axis of the cylinder and ignition spark is provided through a second spark plug positioned in the cylinder near a wall of the cylinder. The first spark plug is disabled during a test period in one of the cylinders and it is determined whether a misfire has occurred during the period that the first spark plug is disabled. A misfire provides an indication of a malfunction of the second spark plug. An advantage of this aspect of the present invention in providing smoother engine operation during the diagnostic procedure than prior art methods in engines with one of the spark plugs located near a cylinder wall and one of the spark plugs centrally located. When prior art approaches are used to diagnose the spark plugs located near a wall in a dual bank engine, the centrally located plug along an entire bank of cylinders are disabled simultaneously. Even if none of the spark plugs being diagnosed were malfunctioning, simply by performing the diagnostic procedure torque drops about 15% during the disablement due to the loss of combustion initiation in the dominant position, the central position. Such a torque drop would be noticeable and objectionable to the driver. The situation is even worse if the prior art diagnostic routine were performed on an engine with a single bank of cylinders. The present invention, in contrast, provides for diagnosing one cylinder at a time resulting in a torque loss of about 5% (in a 6-cylinder engine), which is well within the range of normal cycle-to-cycle torque differences.

The above advantages, other advantages, and other features of the present invention will be readily apparent from the following detailed description of the preferred embodiments when taken in connection with the accompanying drawings.

BRIEF DESCRIPTION OF DRAWINGS

The advantages described herein will be more fully understood by reading an example of an embodiment in which the invention is used to advantage, referred to herein as the Detailed Description, with reference to the drawings wherein.

DETAILED DESCRIPTION

Figure 1:
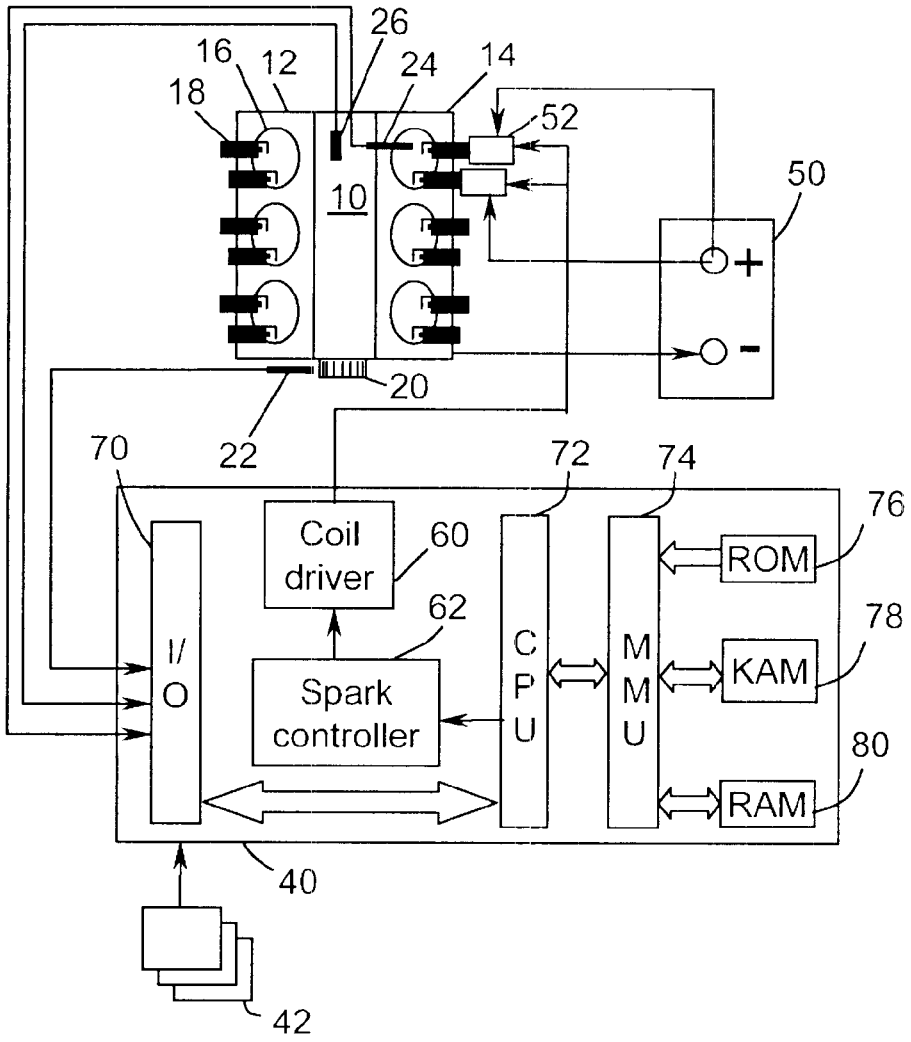
FIG. 1 is a schematic of a V-6 engine with two spark plugs per cylinder.

In FIG. 1 a six-cylinder engine 10 is shown. Engine 10 contains two banks, 12 and 14, of cylinders with three cylinders in each bank. The present invention applies to any number of engine banks with any number of cylinders per bank. Each cylinder 16 contains two spark plugs 18. However, the present invention also applies to more than two spark plugs per cylinder. Spark plugs 18 may be arranged in various configurations in the cylinder and will be discussed more fully below in regards to FIGS. 2 and 3. Spark plugs 18 are connected to ignition coils 52, shown for one cylinder only in FIG. 1. The configuration shown in FIG. 1 is commonly called coil on plug. The present invention also applies to other coil configurations. Ignition coils 52 are connected to battery 50, which supplies battery voltage to the low voltage side of ignition coil 52. Ignition coil 52 transforms low voltage to high voltage, which is provided to spark plugs 18. Ignition coils 52 are controlled or switched by coil driver 60, which is shown on board electronic control unit 40 (ECU) in FIG. 1. However, coil driver 60 may be mounted elsewhere and provide the same function. A signal is supplied by spark controller 62 to cause coil driver 60 to switch, thereby causing spark firing.

Various devices may be used to assess whether combustion occurs in response to a request for spark plug firing. Engine 10 has a toothed disk 20 coupled to the crankshaft (not shown) of engine 10. Sensor 22 provides an output as the teeth of toothed disk 20 pass by sensor 22. Engine speed can be computed based on the signal from teeth passing sensor 22. Engine speed drops momentarily when a cylinder experiences a misfire, i.e., combustion failure. Alternatively, a misfire is detected by an engine sensor 24 as shown in FIG. 1, by way of example, in one cylinder of engine 10. However, each cylinder 16 of engine 10 preferably would contain engine sensor 24. Engine sensor 24 may be a luminosity detector which senses the light in the cylinder entering the detector. As combustion emits visible light, detection of light can be used to indicate whether combustion has been initiated. Alternatively, engine sensor 24 may be a pressure sensor. Cylinder pressure increases due to a combustion event; thus, pressure may also be used to determine whether combustion has been initiated. Engine block sensor 26 may be a strain gauge attached to the surface of the engine block, the output of which is affected by the pressure developed in cylinders 16. In FIG. 1, only one engine block sensor 26 is shown. It may be found that multiple engine block sensors 26 are needed to accurately determine whether a combustion event has occurred.

A piston (not shown) is disposed and reciprocates within each cylinder 16 of engine 10. In four-stroke operation, the processes are: an intake stroke during which the piston moves down or away from the cylinder head (not shown) in which the spark plugs 18 are typically disposed, a compression stroke as the piston moves up, an expansion or power stroke as the piston moves down, and an exhaust stroke as the piston moves up. Combustion typically is initiated toward the end of the compression stroke with the majority of combustion occurring during the expansion stroke. If spark plugs 18 fail to ignite the fuel and air mixture in a particular cylinder, the mixture does not combust and the expansion stroke provides much less power to the engine's crankshaft than if a combustion event had occurred. The rotational speed of engine 10 dips slightly when combustion in one of the cylinders fails to occur. The drop in speed, however, is momentary and occur only during part of a revolution of engine 10 because the next cylinder to undergo an expansion stroke produces power causing engine 10 to reattain the speed prior to misfire. Other known methods of detecting engine misfire which may be used to advantage include: detecting an anomalous signal from an gas sensor (not shown) positioned in the engine exhaust which measures exhaust air/fuel ratio and detecting changes in alternator (not shown).

ECU 40 is provided to control engine 10, in general, and spark plugs 18, as shown specifically in FIG. 1. ECU 40 has a microprocessor 72, called a central processing unit (CPU), in communication with memory management unit (MMU) 74. MMU 74 controls the movement of data among the various computer readable storage media and communicates data to and from CPU 72. The computer readable storage media preferably include volatile and nonvolatile storage in read-only memory (ROM) 76, random-access memory (RAM) 80, and keep-alive memory (KAM) 78, for example. KAM 78 may be used to store various operating variables while CPU 72 is powered down. The computer-readable storage media may be implemented using any of a number of known memory devices such as PROMs (programmable read-only memory), EPROMs (electrically PROM), EEPROMs (electrically erasable PROM), flash memory, or any other electric, magnetic, optical, or combination memory devices capable of storing data, some of which represent executable instructions, used by CPU 72 in controlling the engine or vehicle into which the engine is mounted. The computer-readable storage media may also include floppy disks, CD-ROMs, hard disks, and the like. CPU 72 communicates with various sensors and actuators via an input/output (I/O) interface 70. Examples of items that are actuated under control by CPU 72, through I/O interface 70, are fuel injection timing, fuel injection rate, fuel injection duration, throttle valve position, spark plug timing, and others. Sensors 42 communicating input through I/O interface 70 may be indicating engine rotational speed 22, vehicle speed, coolant temperature, manifold pressure, pedal position, throttle valve position, air temperature, exhaust temperature, and air flow 50. Spark plug timing is determined in CPU 62 and communicated to spark controller 62. This configuration of spark controller 62 comprising a separate chip in FIG. 1 is shown by way of example. Alternatively, the functionality of spark controller 62 could be contained in CPU 72. Some ECU 40 architectures do not contain MMU 74. If no MMU 74 is employed, CPU 72 manages data and connects directly to ROM 76, RAM 80, and KAM 78. Of course, the present invention could utilize more than one CPU 72 to provide engine control and ECU 40 may contain multiple ROM 76, RAM 80, and KAM 78 coupled to MMU 74 or CPU 74 depending upon the particular application.

Figure 2:
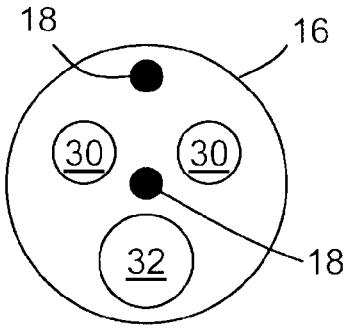
FIG. 2 is a cross-sectional representation of the valves and spark plugs as they may be arranged in a single cylinder of the engine.
Figure 3:
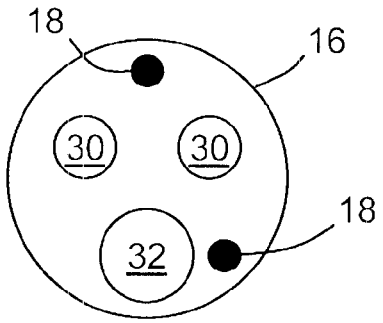
FIG. 3 is a cross-sectional representation of the valves and spark plugs as they may be arranged in a single cylinder of the engine.

In FIG. 2, an example of a two spark plug 18 arrangement is shown for one cylinder in which one spark plug 18 is centrally located and one spark plug 18 is located near the periphery of the cylinder 16, near the cylinder 16 wall. In this case, the central plug may be considered a primary plug and the peripheral plug a secondary plug. The primary initiates the primary combustion event; and the secondary plug assists with later combustion or may provide additional certainty of combustion under marginal circumstances, such as cold start, high dilution of the combustion gases with burned gases, or lean burn. Also shown in FIG. 2, by way of example, are two exhaust valves 30 and an intake valve 32. Another alternative is shown in FIG. 3, in which both spark plugs 18 are located near a cylinder 16 wall. In this case, both plugs provide substantially similar combustion waves, i.e., neither is considered a dominant plug. Regardless of spark plug 16 configuration and their relative importance in initiating combustion, the present invention may be applied to any multiple plug configuration. Also, the exhaust valves 30 and intake valve 32 configuration shown in FIGS. 2 and 3 is merely illustrative and the present invention applies to any arrangement, combination, and number of intake and exhaust valves.

Figure 4:
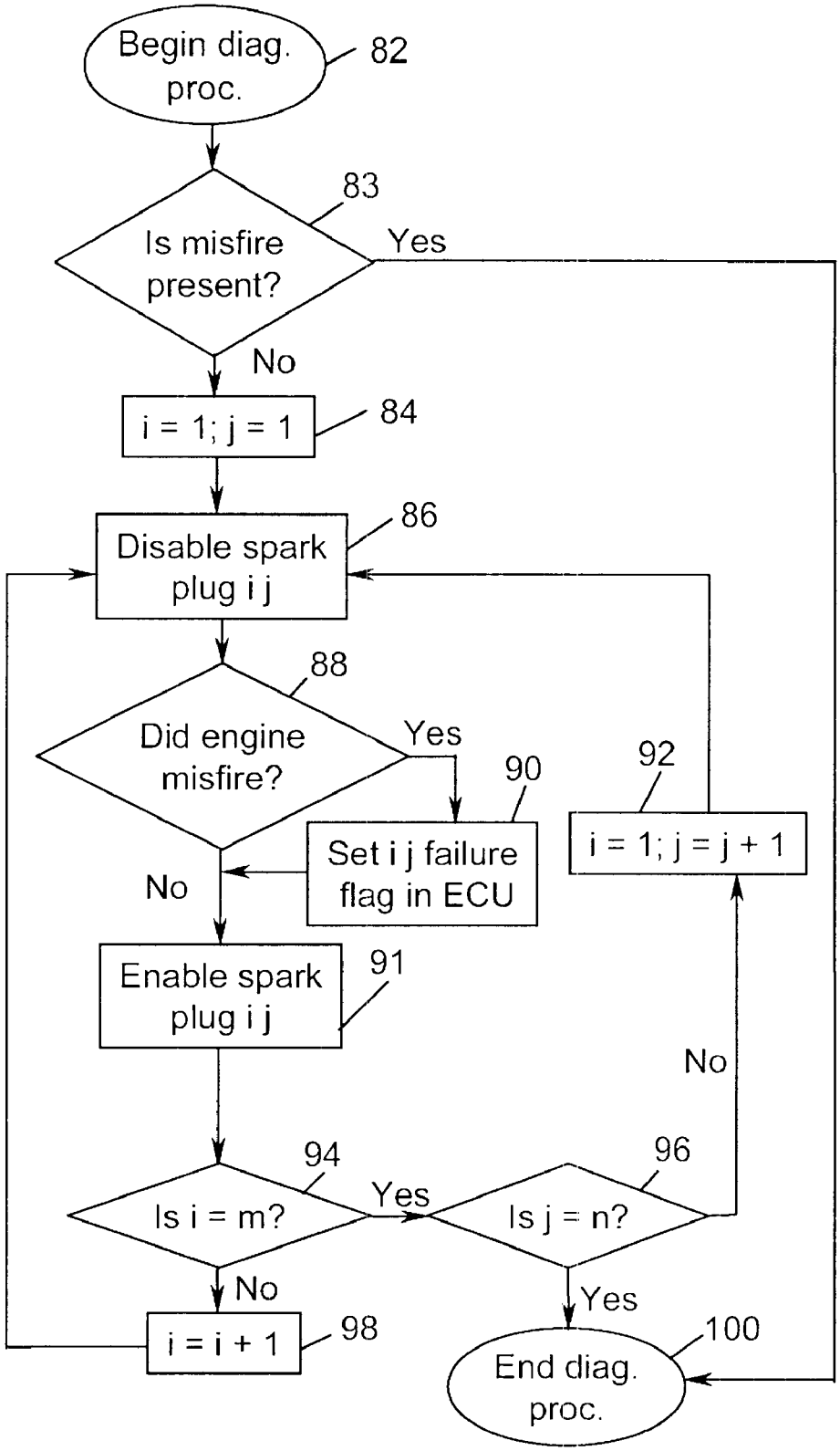
FIG. 4 is a flowchart indicating steps by which the present invention may be used to advantage.

Referring now to FIG. 4, a diagnostic procedure for detecting a spark plug malfunction begins in step 82. The diagnostic procedure of the present invention depends on there not being a misfire, possibly due to a cause other than a spark plug malfunction such as low compression in a cylinder or a fuel injector problem. Thus, before getting to the heart of the detection scheme in which various spark plugs are temporarily disabled, it is determined if there is a misfire occurring in step 83. If there is a misfire occurring (positive result in step 83), the diagnostic procedure is discontinued by proceeding directly to step 100. If there is no misfire, i.e., a negative result in step 83, control passes to step 84, in which counters i and j are initialized to 1. Counter i is the cylinder number on the bank and j is the number of the bank. Control passes to step 86 in which one of the ij spark plugs are disabled. The testing may commence on the primary spark plug of each cylinder of the secondary spark plug in each cylinder. Alternately, these could be termed first and second spark plugs. If the primary spark plug is the subject of the diagnostic procedure, the secondary spark plug is the one that is disabled. The discussion below assumes the diagnostic procedure is being performed on the primary spark plug in each cylinder. In step 88 it is determined if the engine experienced a misfire during the time of disablement of the secondary spark plug in the ij cylinder. If a positive result in step 88, control passes to step 90 in which a flag is set in ECU 40 indicating that the primary spark plug in the ij cylinder misfired. Control then passes to step 91; similarly control passes to step 91 if a negative result is returned in step 88. Regardless, in step 91 the secondary spark plug in the ij cylinder is enabled. Control then passes to step 94 where it is determined whether i=m. In the example of the V-6 engine, the number of cylinders per bank is 3; thus, m is 3, and the number of banks is 2; thus, n is 2. The diagnostic procedure is set up to assess all of the cylinders by counting i=1 through 3 and j=1 through 2, through all combinations. If a negative result is returned in step 94, control passes to step 98 where counter i is incremented and control passes back to step 86 where the secondary spark plug in the new ij cylinder is disabled for assessment of the primary plug. If a positive result is returned in step 94, this indicates that all of the cylinders on the jth bank have been assessed and control passes to step 96 in which it is determined whether j is equal to n. If a positive result is returned in step 96, the diagnostic procedure is terminated in step 100. If a negative result is returned in step 96, counter i is reset and counter j is incremented in step 92. Control then passes to step 86 where the new ij cylinder is assessed. Alternatively, the flowchart in FIG. 2 could be configured such that counter i counts through all the cylinders without regard for banks. Consequently, all references to j and n would be removed; step 94 would proceed directly to step 100; and, steps 92 and 96 would be removed. In this case, m would be equal to the total number of cylinders, eg., 6 for engine 10 of FIG. 1.

The procedure described in conjunction with FIG. 4 may be used for a first spark plug in each cylinder and repeated to assess a second spark plug in each cylinder. The present invention may be extended to a cylinder with more than two spark plugs. To assess a malfunction of a particular spark plug in such a configuration, all other spark plugs in that cylinder are disabled briefly to determine if the particular spark plug is malfunctioning.

The method for detecting a malfunction of a spark plug in a multiple plug described herein produces a momentary misfire of a cylinder, if a malfunctioning plug exists, an unlikely event. If this unlikely event does occur, no substantial functional disturbance to the engine performance results. Although this causes a slight drop in engine speed, if measured on the time scale of a part of a revolution, it is unnoticeable to the average operator. Instead, a savvy operator may notice the misfire only by aural cues, not by a noticeable drop in engine speed. The misfire causes a discharge of unburned fuel and air from the engine 10, which reacts in a catalytic converter, if engine 10 is so equipped. Oxidation of fuel in the catalytic converter leads to a large temperature rise in the catalytic converter and may harm the catalytic converter, particularly if several misfire events occur in rapid succession. Thus, although a single misfire event may be tolerated by the engine system, multiple misfire events should be avoided.

While several modes for carrying out the invention have been described in detail, those familiar with the art to which this invention relates will recognize alternative designs and embodiments for practicing the invention. The above-described embodiments are intended to be illustrative of the invention, which may be modified within the scope of the following claims.

What is claimed is:

1. A method for controlling and diagnosing a multi-cylinder internal combustion engine having a first and a second spark plug disposed in each cylinder to determine spark plug malfunction, comprising the steps of:

disabling the second spark plug during a predetermined test period in a predetermined cylinder wherein the second spark plug is disabled only once during said predetermined test period; and detecting whether a misfire has occurred during said disablement of the second spark plug, said misfire providing an indication of malfunction of the first spark plug.

2. The method of claim 1 wherein said malfunction is based on a decrease in the engine's rotational speed in response to said disablement of said first spark plug.

3. The method of claim 1 wherein said malfunction is based on an output of an engine rotational speed sensor located proximately to a toothed disk coupled to the engine.

4. The method of claim 2 wherein said malfunction is detected when engine speed decreases more than a predetermined amount during a single engine revolution in which said predetermined cylinder undergoes an expansion stroke.

5. The method of claim 1 further comprising the steps of enabling said first spark plug in response to said detection step.

6. The method of claim 1 further comprising the step of performing said disabling and detection steps on successive cylinders.

7. The method of claim 1 further comprising the step of storing in memory an identification of said predetermined cylinder in the event that a malfunction is detected.

8. A method for controlling and diagnosing a multi-cylinder internal combustion engine, comprising the steps of:

providing a first ignition spark in one of the cylinders near a center axis of said cylinder;

providing a second ignition spark in said cylinder near a wall of the cylinder;

disabling said second ignition spark in said cylinder only once during a predetermined test period; and detecting whether a misfire has occurred during said disablement of said second ignition spark, said misfire providing an indication of malfunction of said first ignition spark.

9. The method of claim 8, further comprising the step of enabling said second ignition spark in response to said detection step.

10. The method of claim 8 further comprising the step of performing said disabling and detection steps on successive cylinders.

11. The method of claim 8 further comprising the step of storing in memory an identification of said one of the cylinders in the event that a misfire is detected.

12. A method for diagnosing an internal combustion engine having a plurality of cylinders, each one of the cylinders having at least a first spark plug and a second spark plug, each spark plug providing an ignition spark into the cylinder, the method comprising:

sequentially testing each one of the cylinders for a defective ignition spark during a test cycle comprising disabling all of said spark plugs for each one of the plurality of cylinders, except for the first spark plug of only a predetermined one of the plurality of cylinders during the test cycle wherein the test cycle is performed prior to obtaining information whether any of the ignition sparks provided to any of the plurality of cylinders is improperly operating; and detecting whether a misfire has occurred during said disabling.

13. The method of claim 12, further comprising enabling said disabled spark plug.

14. The method of claim 13, further comprising performing successively said disabling, said detecting, and said enabling in all cylinders other than said predetermined cylinder.

15. The method of claim 14, further comprising:

performing in said predetermined cylinder: disabling all of said spark plugs for each one of the plurality of cylinders, except for the second spark plug, said detecting, and said enabling; and performing successively said diabling, detecting, and enabling in all cylinders other than said predetermined cylinder.

16. The method of claim 12, wherein said detecting is based on a decrease in the engine's rotational speed.

17. The method of claim 16, said rotational speed is based on an output of an engine rotational speed senor located proximately to a toothed disk coupled to the engine.

18. The method of claim 12 wherein said detecting is based on a signal from one of a luminosity detector coupled to said predetermined cylinder and a pressure transducer coupled to said predetermined cylinder.

19. A method for diagnosing ignition spark malfunction in an internal combustion engine having a plurality of cylinders, each one of the cylinders having first and second spark plugs disposed therein, the first and second spark plugs providing first and second ignition sparks into the cylinder to which the spark plugs are coupled, comprising:

sequentially presenting each one of the cylinders for diagnosing the first and second ignition sparks therein during a test period;

disabling the second spark plug when each one of such cylinders is presented for diagnosing, such disabling being when the first and second spark plugs in the other ones of the cylinders are enabled for firing wherein each one of the second spark plugs is disabled only once during said test period;

detecting, in response to monitored engine condition, whether a misfire has occurred during said disablement of the second spark plug; and providing, in response to the detecting of misfire in the second spark plug, an indication of malfunction of the first ignition spark in the one of the cylinders having the disabled second spark plug.

20. The method of claim 19 wherein said presenting of each one of the cylinders being performed prior to having information indicating whether there is a malfunctioning of one of the plurality of first ignition sparks or one of the plurality of second ignition sparks.

21. A method for diagnosing an internal combustion engine having:

a plurality of cylinders;

a plurality of first spark plugs, each one thereof coupled to a corresponding one of the plurality of cylinders and providing a first ignition spark to said corresponding one of the plurality of cylinders; and, a plurality of second spark plugs, each one thereof being coupled to a corresponding one of the plurality of cylinders and providing a second ignition spark to said corresponding one of the plurality of cylinders, such method comprising:

performing a test to determine whether a malfunction of one of the first ignition sparks is occurring, such test being performed prior to having information indicating whether there is a malfunctioning of one of the plurality of first ignition sparks or one of the plurality of second ignition sparks, such test comprising:

sequentially disabling a different one of the plurality of second spark plugs; and detecting whether a misfire is being experienced in the one of the plurality of cylinders during said sequential disablement of the plurality of second spark plugs, a detection of such misfire indicating a malfunction of a first ignition spark coupled to such cylinder experiencing such misfire.

22. The method of claim 21 wherein each one of the second spark plugs is disabled only once during said test.

* * * * *